United States Patent [19]

Schwartz

[11] Patent Number: 4,565,522

[45] Date of Patent: Jan. 21, 1986

[54] SHIELDED FLARE GAS BURNER

[75] Inventor: Robert E. Schwartz, Tulsa, Okla.

[73] Assignee: John Zink Company, Tulsa, Okla.

[21] Appl. No.: 697,572

[22] Filed: Feb. 1, 1985

Related U.S. Application Data

[63] Continuation-in-part of Ser. No. 645,420, Aug. 29, 1984.

[51] Int. Cl.[4] ..... F23D 21/00

[52] U.S. Cl. ..... 431/202; 431/284

[58] Field of Search ..... 431/202, 284, 285

[56] References Cited

U.S. PATENT DOCUMENTS

| | | | |
|---|---|---|---|
| 2,506,972 | 5/1950 | Schellentrager et al. | 431/202 |
| 2,537,091 | 1/1951 | Rodman et al. | 431/202 |
| 3,231,004 | 1/1966 | Reed . | |
| 3,730,673 | 5/1973 | Straitz | 431/202 |
| 3,982,881 | 9/1976 | Schwartz et al. . | |

OTHER PUBLICATIONS

"Advances in Offshore Flaring Technology," by Robert Schwartz and Horst Glomm, presented at a Seminar on Flare Systems arranged by The Norwegian Society of Chartered Engineers, 1982.

"Flaring in Hostile Environments," by Robert Schwartz and Michael Keller, presented at a Seminar on Flare Systems arranged by The Norwegian Society of Chartered Engineers, 1982.

*Primary Examiner*—Carroll B. Dority, Jr.

*Attorney, Agent, or Firm*—C. Clark Dougherty, Jr.

[57] ABSTRACT

A flare gas burner is provided which is less susceptible to damage caused by internal and/or external burning. An external protective covering is attached over the exterior wall surfaces of the burner and an internal protective covering is attached within the interior of the burner. Conduits associated with pilot flame burners and ignitors are disposed within the flare gas burner and within the internal covering therein whereby they are shielded from flame impingement and excessive heat.

17 Claims, 6 Drawing Figures

SHIELDED FLARE GAS BURNER

Cross-Reference to Related Application

This application is a continuation-in-part of Application Ser. No. 645,420 filed Aug. 29, 1984.

BACKGROUND OF THE INVENTION

1. Field of the Invention

The present invention relates generally to flare gas burners, and more particularly, but not by way of limitation, to an improved shielded flare gas burner adapted to be connected to a flare gas conduit or stack.

2. Description of the Prior Art

Flares are commonly utilized for disposing of gases, both waste gases and gases flared as a result of equipment shut-downs, plant upsets, etc. The flared gases are burned by a flare burner either continuously or intermittently, and to insure that the flared gases are ignited and that the burning thereof is maintained, continuously burning pilot flames are generally provided at the flare gas burner.

Flare burners utilized for flaring gases which produce smoke when burned have in many cases included provision for injecting a smoke supressant such as steam or a steam-air mixture into the burning gases whereby smoke emissions therefrom are reduced or eliminated. The smoke suppressant can be injected from within the flare burner, but generally it has been found that for the most efficient and effective suppression, at least some of the suppressant should be injected into the burning zone from points around the periphery of the burner flare gas discharge end.

While a variety of flare gas burner designs and multiple burner arrangements have been developed and used heretofore, in applications where a high maximum flow rate of flare gas is to be handled by the flare, a single flare gas burner of relatively large diameter is often used. Unfortunately, most of such flares seldom, if ever, operate at the maximum flow condition, and consequently, the flares frequently handle gas flow rates which are only small fractions of the maximum. The low flow rates in combination with wind acting on the flare gas burner often cause internal and/or external burning which bring about the early failure of the burner.

Internal burning occurs as a result of wind blowing transversely to the longitudinal axis of a flare gas burner when a low rate of gas is flowing through the burner. The wind causes a low pressure zone to develop within the open discharge end of the burner which in turn causes air to be drawn into the burner. As the air and gas mix within the burner, internal burning takes place. Such internal burning can cause flame impingement and excessive heat damage to the internal walls of the burner which can and usually does drastically shorten the life of the burner.

While increased gas flow rates overcome the problem with internal burning, the combination of a gas flow rate which is still less than maximum and wind can bring about an undesirable condition of external burning. That is, as wind strikes a flare gas burner, a high pressure zone is developed on the windward side and a low pressure zone is developed on the leeward side. At certain less than maximum flow rates of gas through the flare gas burner, the low pressure zone created by the wind and the wind force against the flame above the burner cause a portion of the flame to move or to be pulled into the low pressure zone on the leeward side of the flare burner. This in turn brings about flame impingement and excessive heat damage to wall portions of the burner and its appurtenances.

Low pressure zones which promote external burning are also readily formed by wind acting on the portions of flare burners which extend outwardly from the external sides of the burners such as pilot flame burners and associated fuel gas conduits, ignitor apparatus, smoke suppressant nozzles and supply conduits and the like. External burning in such low pressure zones brings about damage to the burner as well as to the conduits and other protruding portions thereof.

By the present invention, an improved flare gas burner is provided which is shielded from heat and flare impingement damage brought about by internal and/or external burning thereby significantly increasing the operational life of the burner.

SUMMARY OF THE INVENTION

A heat and flame impingement shielded flare gas burner adapted to be connected to a flare gas stack or conduit is provided. The burner is comprised of a tubular member having a discharge end and an inlet end. An external protective covering formed of refractory material is attached to the tubular member at the discharge end portion thereof whereby an aerodynamically smooth heat and flame impingement shield is provided thereon. A smoke suppressant manifold adapted for connection to a source of smoke suppressant to optionally positioned exteriorly of the tubular member and a plurality of smoke suppressant conduits are optionally connected to the manifold and extend through a wall and interiorly of the tubular member adjacent the discharge end thereof. Pilot flame burner means for igniting flare gas discharged from the tubular member are positioned within and adjacent the discharge end thereof and are connected to conduit means for supplying fuel thereto. The pilot fuel conduit means also extend through a wall and interiorly of the tubular member to the pilot burner means. An internal protective covering formed of refractory material is attached over the plurality of smoke suppressant conduits, if included, over the pilot fuel conduit means and over the interior wall surfaces of the tubular member at the discharge end portion thereof whereby the conduits and interior wall surface are shielded from heat and flame impingement.

It is, therefore, a general object of the present invention to provide a heat and flame impingement shielded flare gas burner.

Another object of the present invention is the provision of a flare gas burner which is shielded to reduce the damaging effects of flame impingement, excessive heat, etc., caused by internal and/or external burning.

A further object of the present invention is the provision of a flare gas burner wherein the pilot flame burner fuel gas, igniter and smoke suppressant conduits are positioned interiorly of the burner and are shielded by protective coverings of refractory material to thereby substantially lessen damage resulting from internal and/or external burning and to provide an aerodynamically improved external surface on the burner.

Other and further objects, features and advantages of the present invention will be readily apparent to those skilled in the art upon a reading of the description of preferred embodiments which follows when taken in conjunction with the accompanying drawings.

DESCRIPTION OF THE PREFERRED EMBODIMENTS

Figure 1:
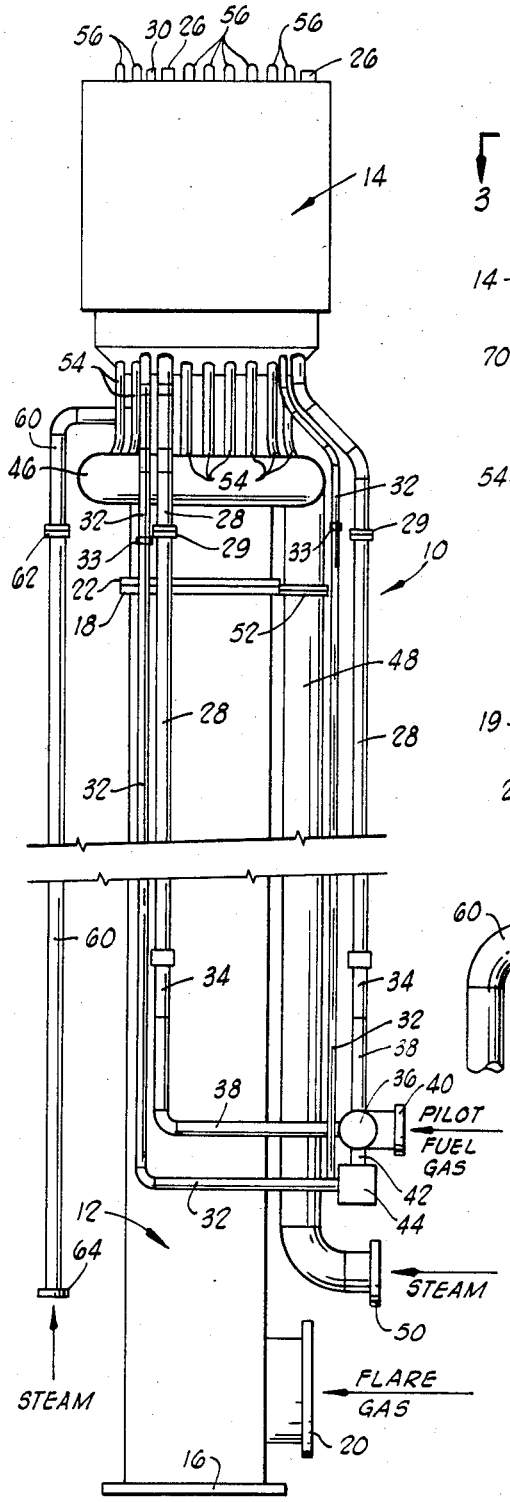
FIG. 1 is a side elevational view of a typical flare stack including the flare gas burner of the present invention.

Referring now to the drawings, and particularly to FIG. 1, a typical flare stack which includes a shielded flare gas burner of the present invention is illustrated and generally designated by the numeral 10. The flare stack 10 includes a lower conduit section 12 which is connected to a flare gas burner 14 of this invention. The lower conduit section 12 is of a size which will handle the maximum flow rate of gas to be flared and includes a closed bottom end or base 16 and a flange connector 18 at the top end connected to the burner 14. A flanged inlet connection 20 is provided adjacent the base 16. The flare stack 10 can be positioned vertically as shown, horizontally or at an angle therebetween.

Figure 2:
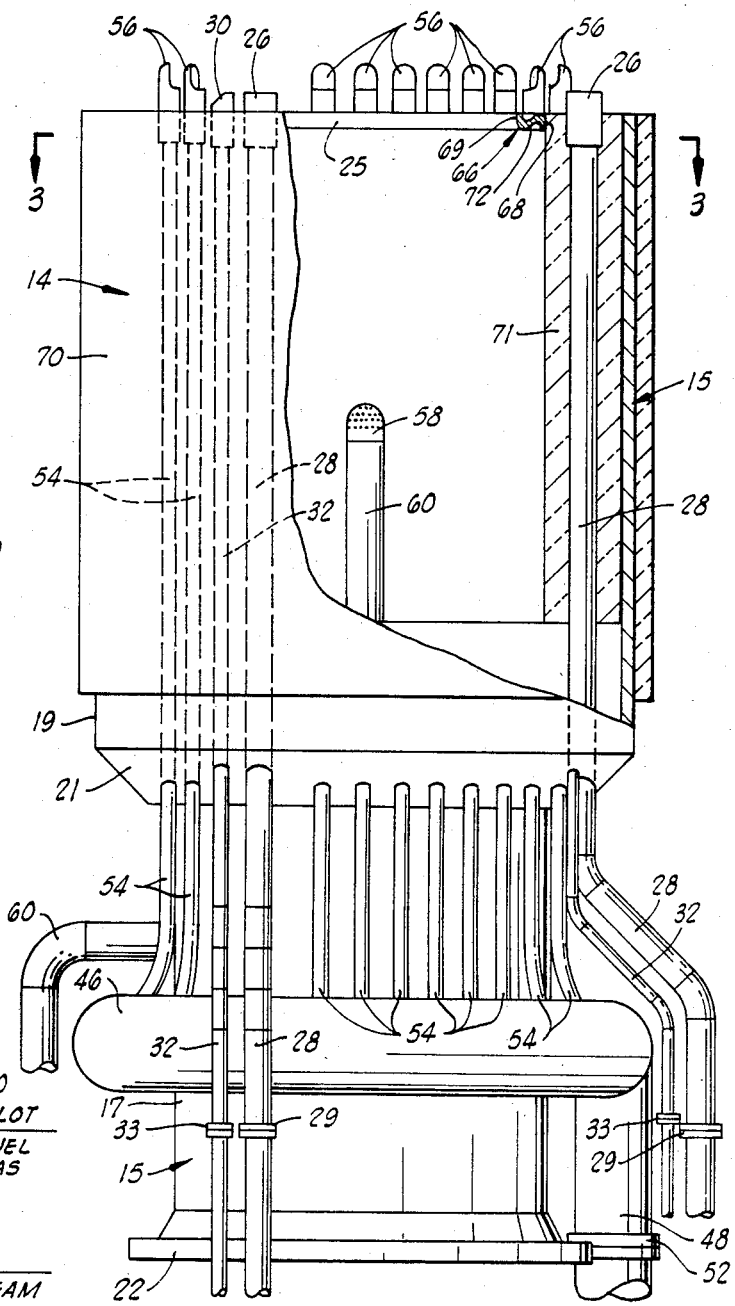
FIG. 2 is an enlarged partly sectional side elevational view of the burner of FIG. 1.
Figure 3:
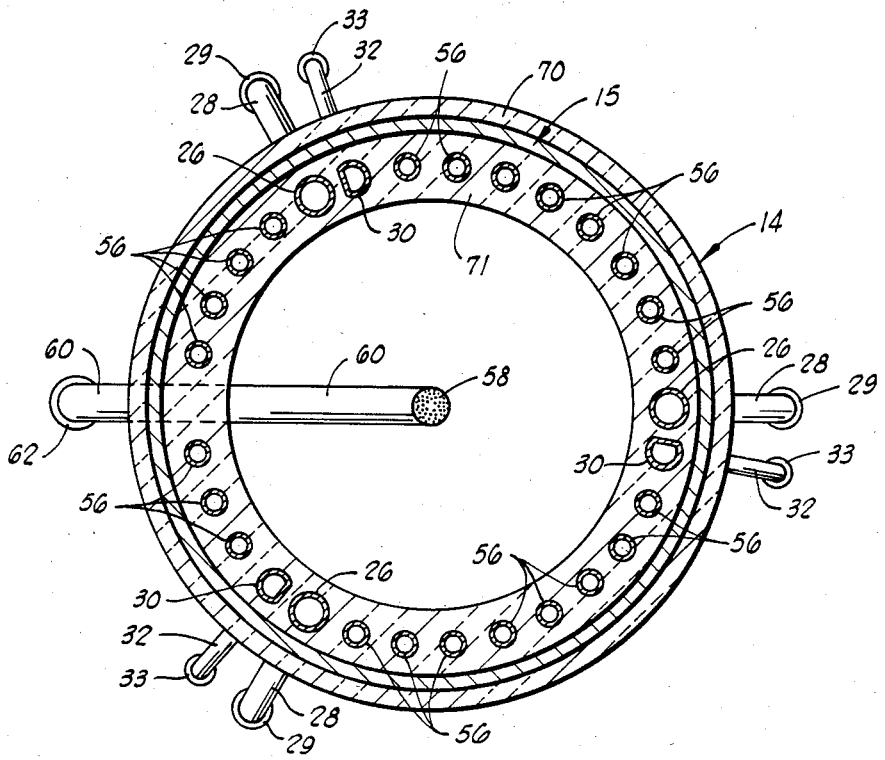
FIG. 3 is a cross-sectional view taken along line 3—3 of FIG. 2.

Referring specifically to FIGS. 2 and 3, the flare gas burner 14 is comprised of a tubular member 15 having an inlet flange 22 at its lower end which is connected to the flange 18 of the conduit section 12 and an upwardly facing opening 24 at the upper end thereof. The upper portion 19 of the tubular member 15 is enlarged, i.e., the upper portion 19 is of a larger diameter than the lower portion 17, and the upper enlarged portion 19 is connected to the lower portion 17 by a transition wall 21.

Three pilot flame burners 26 are positioned inside and around the periphery of the discharge end of the upper portion 19 of the tubular member 15 and are removably connected to conduits 28. Positioned adjacent the pilot flame burners 26 are ignitor heads 30 which are removably connected to conduits 32. The conduits 28 and 32 extend interiorly of the tubular member 15 between the burners 26 and ignitor heads 30, respectively, and the transition wall 21. The conduits pass through the wall 21 and then extend exteriorly of the tubular member 15. The conduits 28 connect to air-fuel gas mixers 34 which are in turn connected to a fuel gas header 36 positioned at the bottom portion of the flare stack by conduits 38. Fuel gas header 36 includes a fuel gas inlet connection 40 connected thereto, and the header 36 is connected by a conduit 42 to an ignitor apparatus 44 which is in turn connected to the conduits 32. The conduits 28 include flange connections 29 therein and the conduits 32 include flange connections 33 which facilitate the installation or removal of the burner 14.

A smoke suppressant manifold 46 formed in a ring around the tubular member 15 is attached exteriorly of the tubular member adjacent the inlet end flange connector 22 thereof. The manifold 46 is connected to a conduit 48 for supplying smoke suppressant thereto which extends to the bottom portion of the stack 10 and has a flange connector 50 attached thereto. A flange connection 52 is provided in the conduit 48 adjacent the flange 22 of the tubular member 15. A plurality of conduits 54 are connected to the manifold 46 which extend through the transition wall 21 of the tubular member 15 and interiorly thereof to the upper end thereof. Removably connected to the conduits 54 within and around the periphery of the discharge opening 24 of the tubular member 15 are smoke suppressant discharge nozzles 56 which direct smoke suppressant into the flare gas.

A smoke suppressant discharge nozzle 58 is disposed within the tubular member 15. The nozzle 58 is connected to a conduit 60 which extends through a wall of the lower portion 17 of the tubular member 15 to the bottom portion of the stack 10. A flange connection 62 is provided in the conduit 60 adjacent the inlet flange 22 of the member 15 and a flange connector 64 is attached at the lower end thereof.

In operation of the flare stack 10, gas to be flared is conducted to the flare gas inlet 20 of the stack 10 from where it flows upwardly through the lower conduit section 12 and through the flare gas discharge opening of the burner 14 to the atmosphere. As the flare gas flows through the discharge opening of the burner 14 into the atmosphere, it is ignited by the pilot flames continuously emitted from the pilot burners 26 and burned.

Fuel gas is supplied from a source thereof to the pilot fuel gas header 36 by way of the inlet connection 40 thereof. The fuel gas flows through the conduits 38 to the fuel gas-air mixers 34 wherein the fuel gas mixes with air and the resulting mixture flows by way of the conduits 28 to the pilot burners 26.

Piliot flames are continuously produced at the pilot burners so that whenever flare gas flows through the stack 10 and discharges from the burner 14, it is ignited and burned. When the pilot burners are initially ignited or when they have to be reignited, the ignitor system comprised of the ignitor heads 30 positioned adjacent the pilot flame burners 26, the conduits 32 and the ignitor apparatus 44 is utilized. That is, the ignitor apparatus 44 produces a fuel gas-air mixture which is ignited and caused to flow by way of the conduits 32 to the ignitor heads 30. When the burning gas-air mixture reaches and is discharged from the heads 30 adjacent the pilot flame burners 26, fuel-air mixtures emitted from the burners 26 are ignited thereby. As is well understood by those skilled in the art, various pilot flame ignitor systems and apparatus have been developed which are commercially available, any of which can be utilized with the flare stack 10.

The conduit 50 is connected to a source of smoke suppressant such as steam or a steam-air mixture and conducts the smoke suppressant to the manifold 46. From the manifold 46 the smoke suppressant is conducted by the conduits 54 to the nozzles 56 which discharge streams of the smoke suppressant into the burning flare gas immediately downstream of the burner discharge opening whereby smoke formation is suppressed. Also, a source of smoke suppressant is connected to the conduit 60 which conducts a stream thereof to the nozzle 58 within the tubular member 15. The smoke suppressant is discharged through the nozzle 58 into flare gas flowing through the tubular member 15 whereby it mixes therewith and helps to suppress the formation of smoke.

While the flare stack 10 illustrated in FIG. 1 and described above is typical of a number of flare installations, it is to be understood that the flare gas burner 14 of the present invention can be utilized in various other installations. For example, as mentioned above, the burner 14 can be connected to the end of a conduit which is positioned horizontally or at an angle therewith. Also, one or more burners 14 can be connected directly to a flare gas header.

Referring now to FIGS. 2 and 3, attached to the exterior surface of the upper enlarged portion 19 of the tubular member 15 is an external protective covering 70 formed of refractory material. The term "refractory material" is used herein to mean any material having the ability to endure or resist high temperatures. The external covering 70 is formed in an aerodynamically smooth cylindrical shape whereby low pressure areas caused by wind are minimized.

An internal protective covering 71 formed of refractory material is attached within the discharge end of the upper portion 19 of the tubular member 15 over the pilot fuel gas conduits 28, the ignitor conduits 32, the smoke suppressant conduits 54 and over the upper portion of the interior wall surfaces of the tubular member 15. The pilot burners 26, ignitor heads 30 and smoke suppressant discharge nozzles 56 extend above the top of the covering 71.

A flame retention device 66 is attached at the interior of the covering 71 at the top end thereof. The device 66 includes a cylindrical outer wall 68 connected to a cylindrical inner wall 69 by an undulated connecting wall 72. A plurality of ports (not shown) are disposed in the undulated connecting wall 72 and the inner wall 69 forms a flare gas discharge opening 25. The flame retention device 66 increases the velocity of the flare gases as they flow through the opening 25 formed by the wall 69 and the portions of the flare gases flowing through the ports are burned adjacent the device 66 so that the burning of the main body of gases flowing through the opening 25 is maintained adjacent the device 66.

When internal or external burning occurs as a result of particular combinations of wind and flare gas flow rate, the internal and external surfaces of the tubular member 15 as well as the conduits 28, 32 and 54 are protected from flame impingement, excessive heat, and other adverse conditions brought about by such burning by the coverings 70 and 71. If the pilot burners 26, ignitor heads 30 or smoke suppressant nozzles 56 are damaged, they can be removed and replaced from positions adjacent the top of the burner 14.

Figure 4:
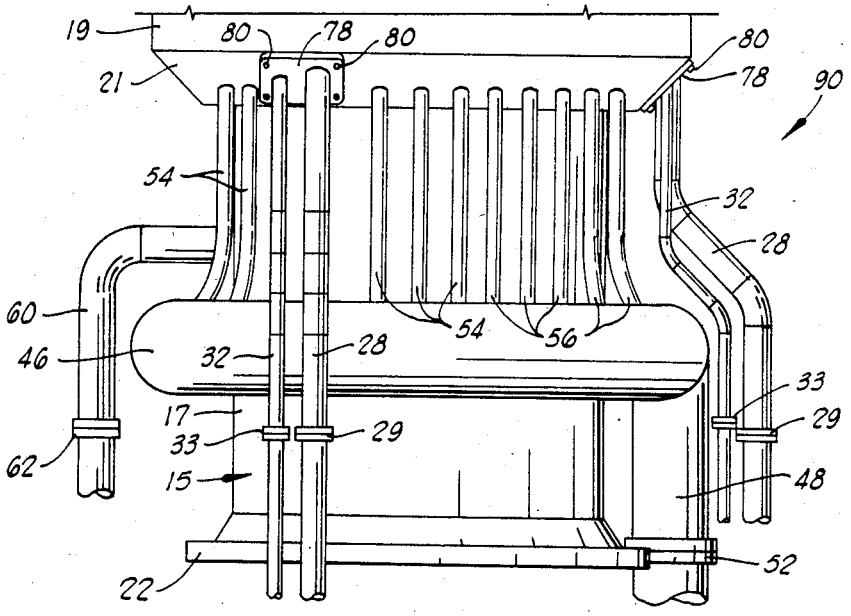
FIG. 4 is a view of the lower portion of a burner similar to that shown in FIG. 2 but including removable parts.
Figure 5:
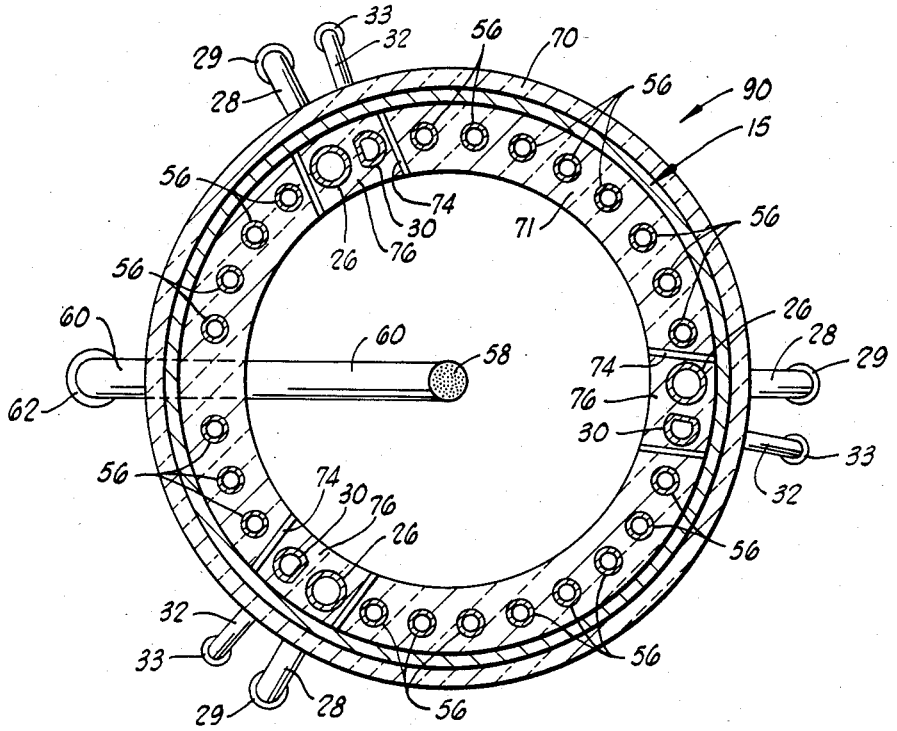
FIG. 5 is a cross-sectional view similar to FIG. 3, but showing a burner having removable parts.

If it is desirable that the pilot flame burners 26 and the ignitor heads 30 of the flare gas burner 14 be replaceable from positions adjacent the lower end portion 17 of the tubular member 15, the burner 14 can include provision for such replacement. More specifically, referring to FIGS. 4 and 5 wherein like numerals to those in FIGS. 1-3 designate like parts, a flare gas burner 90 is illustrated. The internal protective covering 71 of the burner 90 includes three spaced apart longitudinal channels 74 formed therein (FIG. 5). The channels 74 extend from the bottom of the covering 71 to the top thereof, and disposed in each of the channels 74 is an assembly 76. Each assembly 76 is comprised of an upper portion of one of the conduits 28 removably attached to a pilot flame burner 26, an upper portion of one of the ignitor conduits 32 removably attached to an ignitor head 30 and a protective covering of refractory material surrounding the conduit portions. The refractory material covering is formed in a shape which is complementary to the cross-sectional shape of the channel 74. In order to allow the removal of the assemblies 76 and the replacement of burners or other parts thereof, the transition wall 21 of the tublar member 15 includes enlarged openings therein which are closed by removable doors 78 (FIG. 4). The doors 78, for example, can be removably attached to the wall 21 by bolts 80. The conduits 28 and 32 are attached to and extend through the doors 78. Thus, in order to remove an assembly 76 from the flare gas burner 90, the flange connections 29 and 33 in the conduits 28 and 32 are disconnected and the door 78 is disconnected from the wall 21 whereby the assembly 76 can be moved downwardly through the enlarged opening in the wall 21. The burner 26 and/or ignitor head 30 can be replaced in the assembly 76 then reinstalled in the tubular member 15.

In operation of the flare gas burners 14 or 90, if internal or external burning occurs as a result of a particular combination of wind and flare gas flow rate, the internal and external surfaces of the tubular member 15 as well as the conduits 28, 32 and 54 are protected from flame impingement, excessive heat, and other adverse conditions brought about by such burning. In addition, the external wall surface of the upper portion of the burner is aerodynamically improved, i.e., conduits and other parts are not positioned exteriorly of the burner and do not protrude outwardly from the sides thereof whereby low pressure areas associated therewith which promote external burning are eliminated. While the pilot flame burners 26, ignitor heads 30 and smoke suppressant nozzles 56 are partially exposed, they can be replaced as described above.

As will be understood, the particular number of pilot flame burners and associated conduits as well as the particular number of smoke suppressant nozzles and associated conduits utilized with the flare gas burner of this invention depends on a number of design factors such as the maximum flow rate of flare gas, prevailing wind conditions at the location of use, etc. Accordingly, this invention is not to be limited to any particular number of pilot flame burners, ignitors, smoke suppressant nozzles and associated conduit means.

Figure 6:
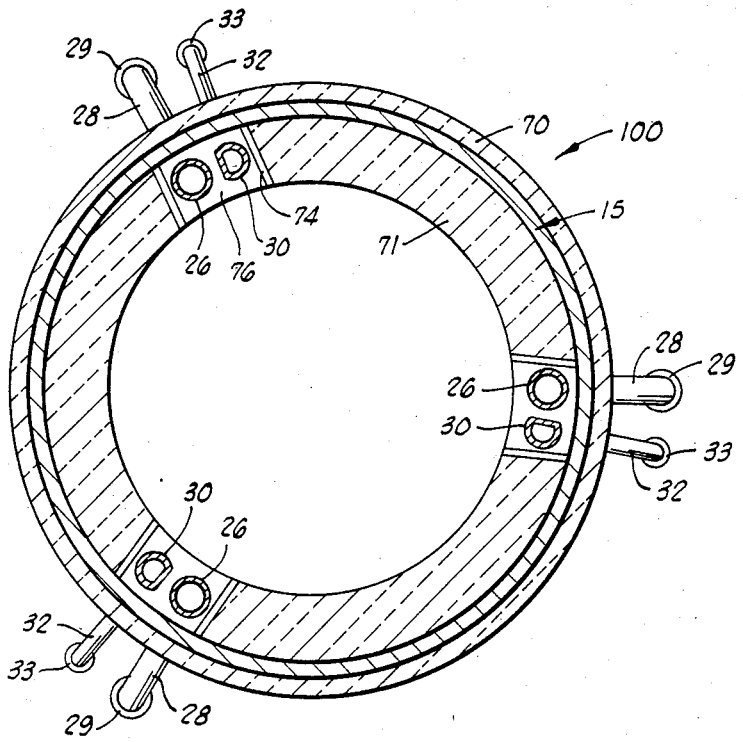
FIG. 6 is a cross-sectional view similar to FIG. 3, but showing a burner with removable parts and without smoke suppressant means.

In some applications of the flare gas burner of this invention, it is not necessary that the burner include means for suppressing smoke. In such instances, the smoke suppressant manifold 46, conduits 54, discharge heads 56, nozzle 58 and conduit 60 can be eliminated, and only the pilot burners, ignitors and conduits associated therewith are encased within the covering 71. Such a burner 100 is illustrated in FIG. 6 wherein like numerals to those used in FIGS. 1-5 designate like parts.

A technique which has been found to be particularly suitable in forming the refractory covering on burners with conduits permanently disposed within the covering is to form the covering encasing the conduits of a refractory material which is relatively soft and flexible followed by the forming of a hard inflexible outside refractory material covering thereover. The soft flexible material of the covering allows a limited movement of the conduits therewithin which is sometimes necessary during installation and operation of the flare burners.

Thus, the present invention is well adapted to carry out the objects and attain the ends and advantages mentioned as well as those inherent therein. While numerous changes in the arrangement and construction of parts can be made by those skilled in the art, such changes are encompassed within the spirit of this invention as defined by the appended claims.

What is claimed is:

1. A heat and flame impingement shielded flare gas burner comprising:

a tubular member having a discharge end and an inlet end;

an external protective covering formed of refractory material attached over the exterior wall surfaces of said tubular member at the discharge end thereof whereby a flame impingement shield is provided thereon;

an internal protective covering formed of refractory material attached over the interior wall surfaces of said tubular member at the discharge end thereof whereby a heat and flame impingement shield is provided thereon; and pilot flame burner means positioned within and adjacent said discharge end of said tubular member attached to conduit means, said conduit means being disposed within said internal protective covering of refractory material whereby said conduit means are also shielded from heat and flame impingement.

2. The burner of claim 1 wherein said pilot flame burner means are removably attached to said conduit means.

3. A heat and flame impingement shielded flare gas burner adapted to be mounted at the end of a flare gas conduit comprising:

a tubular member having a discharge end and an inlet end, the inlet end being adapted to be connected to said flare gas conduit;

an external protective covering formed of refractory material attached over the exterior wall surfaces of said tubuar member adjacent the discharge end thereof whereby a heat and flame impingement shield is provided thereon;

an internal protective covering formed of refractory material attached within said tubular member whereby the interior wall surfaces of said tubular member adjacent the discharge end thereof are covered and a heat and flame impingement shield is provided thereon, said internal covering including at least one longitudinal channel formed therein;

pilot flame burner conduit means having a protective covering of refractory material attached thereto disposed in said channel whereby said conduit means are also shielded; and pilot flame burner means positioned within and adjacent the discharge end of said tubular member attached to said conduit means.

4. The flare gas burner of claim 3 which is further characterized to include pilot burner ignition conduit means having a protective covering of refractory material attached thereto disposed in said channel.

5. The flare gas burner of claim 4 wherein said pilot burner conduit means and said ignition conduit means have a mutual protective covering of refractory material attached thereto formed in a cross-sectional shape complementary to the cross-sectional shape of the channel within which they are disposed.

6. The flare gas burner of claim 5 wherein said pilot burner conduit means and said ignition conduit means are removably attached within said tubular member.

7. In a tubular flare gas burner adapted to be mounted to a flare gas conduit having an inlet end and a discharge end, the improvement whereby said burner is less susceptible to damage caused by internal and/or external burning comprising:

a tubular member having a discharge end and an inlet end, an external protective covering formed of refractory material attached to at least the discharge end portion of said tubular member whereby the external surfaces of said tubular member are substantially shielded from flame impingement and excessive heat caused by external burning;

an internal protective covering formed of refractory material attached within at least the discharge end portion of said tubular member whereby the internal surfaces of said tubular member are shielded from flame impingement and excessive heat caused by internal burning; and pilot burner means positioned within and adjacent the discharge end of said tubular member with conduit means extending thereto, said conduit means being disposed interiorly of said tubular member within said internal protective covering whereby said conduit means are shielded and an aerodynamically improved external surface is provided on the discharge end portion of said tubular member.

8. The burner of claim 7 wherein said internal protective covering attached to said tubular member includes at least one channel formed therein and said conduit means are disposed in said channel.

9. The burner of claim 8 wherein said conduit means have a protective covering of refractory material attached thereto of a shape complementary to the shape of said channel.

10. The burner of claim 9 wherein said conduit means and protective covering attached thereto are removably disposed in said channel.

11. A heat and flame impingement shielded smoke suppressing flare gas burner comprising:

a tubular member having a flare gas discharge end and an inlet end adapted for connection to a source of flare gas;

an external protective covering formed of refractory material attached over the exterior wall surfaces of said tubular member at the discharge end thereof;

a smoke suppressant manifold adapted for connection to a source of smoke suppressant positioned exteriorly of said tubular member;

a plurality of smoke suppressant conduits connected to said manifold and extending through the wall of and interiorly of said tubular member to the discharge end thereof for discharging smoke suppressant at said discharge end;

pilot flame burner means for igniting flare gas discharged from said tubular member positioned within and adjacent the discharge end thereof;

pilot fuel conduit means for supplying fuel to said pilot flame burner means connected to said burner means and extending interiorly of said tubular member;

an internal protective covering formed of refractory material attached over said plurality of smoke suppressant conduits, over said pilot fuel conduit means and over the interior wall surfaces of said tubular member at the discharge end portion thereof whereby said interior wall surfaces, said smoke suppressant conduits and said pilot fuel conduit means are shielded by said protective covering.

12. The burner of claim 11 wherein said pilot flame burner means are removably attached to said pilot fuel conduit means.

13. A heat and flame impingement shielded smoke suppressing flare gas burner adapted to be mounted at the end of a flare gas conduit comprising:

a tubular member having a flare gas discharge end and an inlet end, the inlet end being adapted to be connected to said flare gas conduit;

an external protective covering formed of refractory material attached over the exterior wall surfaces of said tubular member whereby at least the wall surfaces of said tubular member adjacent the discharge end thereof are covered thereby;

a smoke suppressant manifold adapted for connection to a source of smoke suppressant positioned exteriorly of said tubular member adjacent the inlet end thereof;

a plurality of smoke suppressant conduits connected to said manifold and extending interiorly of said tubular member to the discharge end thereof for discharging smoke suppressant into burning flare gas at said discharge end;

an internal protective covering formed of refractory material attached over said plurality of smoke suppressant conduits and over the interior wall surfaces of said tubular member at the discharge end portion thereof whereby said wall surfaces and said conduits are shielded, said covering including at least one longitudinal channel formed therein;

pilot fuel conduit means having a protective covering of refractory material attached thereto removably disposed within said tubular member in said channel; and pilot flame burner means positioned within and adjacent the discharge end of said tubular member removably attached to said conduit means.

14. The flare gas burner of claim 13 which is further characterized to include pilot burner ignition conduit means having a protective covering of refractory material attached thereto also removably disposed in said channel.

15. The flare gas burner of claim 13 wherein said smoke suppressant manifold is formed in a ring disposed around and attached to said tubular member at the inlet end thereof.

16. The flare gas burner of claim 13 wherein said protective covering attached to said pilot burner conduit means is formed in a cross-sectional shape complementary to the shape of the channel within which it is disposed.

17. The flare gas burner of claim 14 wherein said pilot burner conduit means and said ignition conduit means have a mutual protective covering of refractory material attached thereto formed in a cross-sectional shape complementary to the shape of the channel within which it is disposed.

* * * * *